US008528395B2

(12) United States Patent
Griffiths et al.

(10) Patent No.: US 8,528,395 B2
(45) Date of Patent: Sep. 10, 2013

(54) MONITORING FLUID PRESSURE IN A WELL AND RETRIEVABLE PRESSURE SENSOR ASSEMBLY FOR USE IN THE METHOD

(75) Inventors: Neil Griffiths, Rijswijk (NL); James William Hall, Rijswijk (NL)

(73) Assignee: Shell Oil Company, Houston, TX (US)

( * ) Notice: Subject to any disclaimer, the term of this patent is extended or adjusted under 35 U.S.C. 154(b) by 985 days.

(21) Appl. No.: 11/631,735

(22) PCT Filed: Jul. 4, 2005

(86) PCT No.: PCT/EP2005/053162

§ 371 (c)(1),
(2), (4) Date: Feb. 22, 2010

(87) PCT Pub. No.: WO2006/003190

PCT Pub. Date: Jan. 12, 2006

(65) Prior Publication Data

US 2010/0139388 A1 Jun. 10, 2010

(30) Foreign Application Priority Data

Jul. 5, 2004 (EP) ..... 04254033

(51) Int. Cl.
*E21B 47/06* (2012.01)

(52) U.S. Cl.
USPC ..... 73/152.51

(58) Field of Classification Search
USPC ..... 73/152.51
See application file for complete search history.

(56) References Cited

U.S. PATENT DOCUMENTS

| | | | | |
|---|---|---|---|---|
| 3,101,735 | A * | 8/1963 | Brown | 137/155 |
| 4,603,736 | A * | 8/1986 | Moore | 166/117.5 |
| 5,407,010 | A * | 4/1995 | Herschberger | 166/372 |
| 5,457,988 | A * | 10/1995 | Delatorre | 73/152.51 |
| 5,458,200 | A | 10/1995 | Lagerlef et al. | 166/372 |
| 5,488,993 | A * | 2/1996 | Hershberger | 166/372 |
| 5,535,828 | A | 7/1996 | der Kinderen et al. | 166/372 |
| 6,070,608 | A | 6/2000 | Pringle | 137/155 |
| 6,148,843 | A * | 11/2000 | Pringle | 137/155 |
| 6,206,645 | B1 * | 3/2001 | Pringle | 417/54 |
| 6,227,302 | B1 * | 5/2001 | Pringle et al. | 166/374 |
| 6,422,312 | B1 | 7/2002 | Delatorre et al. | 166/250.15 |

(Continued)

FOREIGN PATENT DOCUMENTS

GB 2297568 8/1996

OTHER PUBLICATIONS

Lea J F et al:"What's new in artificial lift part 2—eighteen new downhole/surface system developments from 10 companies for electrical submersible pumping (ESP) and other artificial-lift operations", World Oil, Gulf Publishing Co. Houston, US, vol. 224, No. 5, May 2003, pp. 71-72,74.

*Primary Examiner* — John Fitzgerald

(57) ABSTRACT

A method for monitoring the pressure difference across an ESP comprises:—connecting the ESP (7) to a production tubing (6)—providing the production tubing (6) with a side pocket (9) which comprises an opening (13)—inserting a pressure sensor assembly (10) into the side packet (9) such that the opening (13) is located between a pair of annular seals (14, 15)—monitoring the pressure difference across the ESP (7) by inducing the sensor assembly to measure a pressure difference between an upper section of the side pocket which is in communication with the interior of the tubing and a middle section (16) of the interior of the side packet (9) which is located between the annular seals (14, 15).

6 Claims, 1 Drawing Sheet

(56) References Cited

U.S. PATENT DOCUMENTS

| | | | | |
|---|---|---|---|---|
| 6,464,004 | B1 | 10/2002 | Crawford et al. | 166/250.01 |
| 6,568,478 | B2 | 5/2003 | De Almeida | 166/372 |
| 6,840,317 | B2 | 1/2005 | Hirsch et al. | 166/250.15 |
| 6,958,704 | B2 | 10/2005 | Vinegar et al. | 340/854.3 |
| 7,147,059 | B2 | 12/2006 | Hirsch et al. | 166/372 |
| 7,954,547 | B2 * | 6/2011 | Lowe et al. | 166/250.15 |
| 2002/0020533 | A1 | 2/2002 | Tubel | 166/313 |
| 2003/0038734 | A1 | 2/2003 | Hirsch et al. | 340/853.1 |
| 2003/0164240 | A1 | 9/2003 | Vinegar et al. | 166/372 |
| 2004/0154390 | A1 * | 8/2004 | Baustad | 73/152.55 |

* cited by examiner

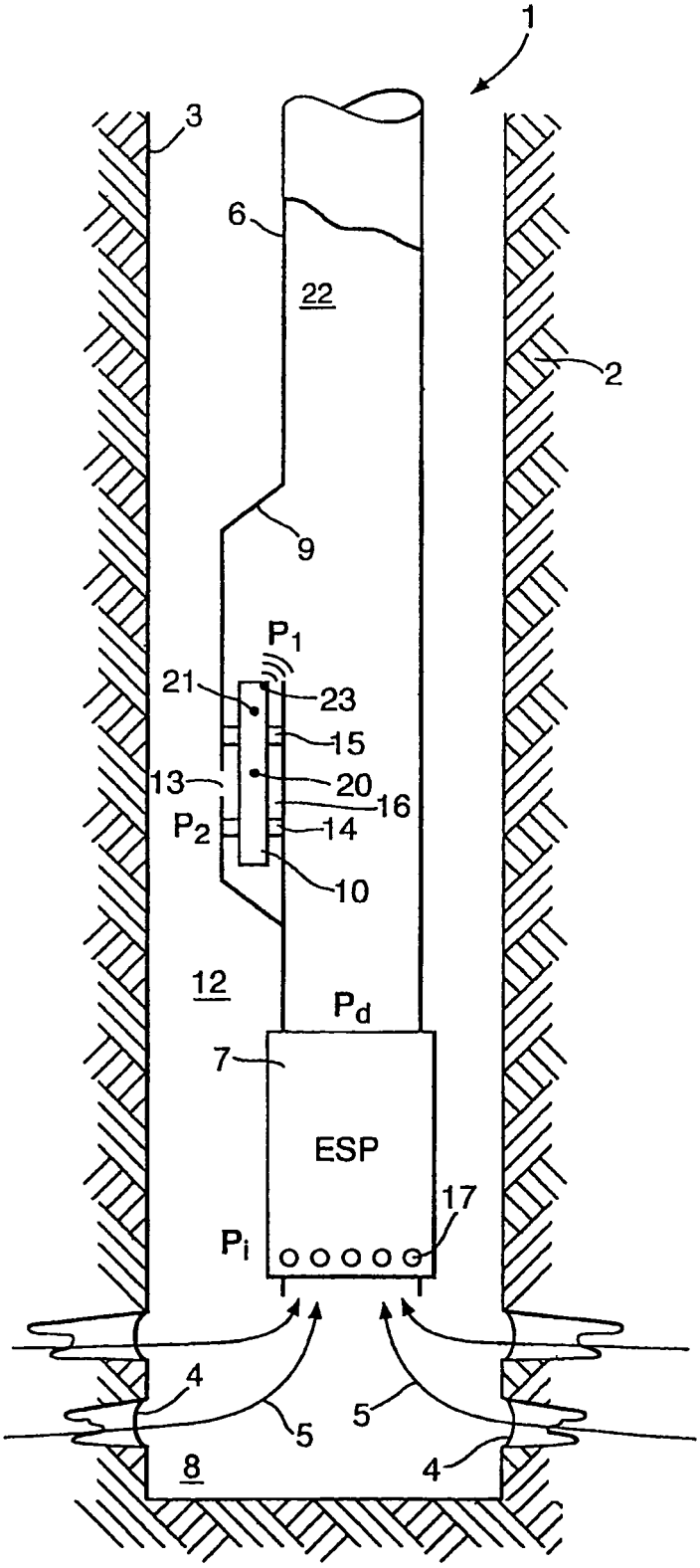
1
3
6
22
2
9
P1
21
23
15
13
20
16
P2
14
10
12
Pd
7
ESP
17
Pi
4
5
5
8
4

MONITORING FLUID PRESSURE IN A WELL AND RETRIEVABLE PRESSURE SENSOR ASSEMBLY FOR USE IN THE METHOD

The present application claims priority from European Patent Application 04253033.6 filed 5 Jul. 2004.

BACKGROUND OF THE INVENTION

1. Field of the Invention

The invention relates to a method for monitoring fluid pressure in a well and to a retrievable pressure assembly for use in the method.

2. Background of the Art

U.S. Pat. No. 6,464,004 discloses installing a pressure monitoring assembly in a side pocket of a production tubing in a well, such that the assembly can be easily installed and retrieved into and from the side pocket by means of a kickover tool that is suspended from a wireline.

The known assembly is configured to monitor the pressure in an annulus between the production tubing and well casing by a pressure gauge, which is arranged in an annular space between the housing of the pressure sensing assembly between a pair of annular seals that are mounted on the housing, which space is in fluid communication with the annulus via an opening in the wall of the side pocket.

The known assembly may also be configured to monitor the pressure in a tubing below an electrical submersible pump, generally known as an ESP, in a well by arranging a pressure monitoring assembly in a side pocket of a production tubing above the ESP and by providing a bypass conduit which is at its lower end connected to the interior of the tubing below the ESP and at its upper end connected to the opening in the wall of the side pocket that is located between the annular seals of the pressure sensing assembly.

A disadvantage of the known pressure sensing assembly is that the presence of a bypass conduit makes the assembly complex and fragile. A further disadvantage is that the known pressure sensing assembly is not configured to monitor the pressure difference across the ESP or other pump.

U.S. Pat. No. 6,568,478 discloses a gas-lift valve with a venturi which stabilises the flux of lift gas injected from the annulus into the crude oil production tubing. The known valve may be retrievably inserted in a side pocket that provides fluid communication between the interior of the production tubing and the surrounding annulus.

SUMMARY OF THE INVENTION

The method according to the invention for monitoring the pressure in a well comprises:

connecting a pump to a production tubing within the well such that the pump pumps well effluents from an inflow region of the well into the production tubing;

providing the production tubing with a side pocket which comprises an opening that provides fluid communication between the interior of the side pocket and an annular space surrounding the production tubing, which space is in fluid communication with the inflow region of the well;

inserting a pressure sensor assembly into the side pocket such that the opening is located between a pair of annular seals that are mounted on the housing of the pressure sensor assembly; and monitoring the pressure difference across the pump by inducing the pressure sensor assembly to measure a pressure difference between a section of the side pocket which is connected in fluid communication with the interior of the production tubing and a section of the interior of the side pocket which is located between the annular seals; wherein the pressure sensor assembly comprises:

a first pressure sensor which measures the fluid pressure in the interior of the side pocket which is connected in fluid communication with the interior of the production tubing;

a second pressure sensor which measures the fluid pressure in the section of the interior of the side pocket which is located between the annular seals; and means for monitoring the difference of the fluid pressures measured by the first and second pressure sensor and for transmitting the measured pressures and/or pressure difference to a data transmission and/or data storage unit.

The housing of the pressure sensor assembly may have a substantially tubular shape and may be provided with a fishing neck for connecting the pressure sensor assembly to a wireline operated or robotic installation tool, which is configured to lower and raise the pressure sensor assembly through the production tubing, and to insert and remove the pressure sensor assembly into and from the side pocket.

The pressure data may be transmitted to surface by a wireless transmission system or stored in the retrievable assembly for subsequent analysis after retrieval of the assembly from the well.

Optionally the pressure sensor assembly is equipped with a data storage unit in which the monitored pressures and/or pressure difference data are stored and the stored data are transferred to a data processing unit after retrieval of the pressure sensor assembly from the well.

Alternatively, the pressure sensor assembly is provided with a data transmission unit for wireless transmission of the measured pressure difference to a receiver which is connected to a monitoring and/or control assembly for monitoring and/or controlling the performance of the pump and with a battery for supplying electrical power to the data transmission unit and to the pressure sensor assembly.

The pump may be an electrical submersible pump (ESP), which is connected to the production tubing within an oil production well.

These and other features, embodiments and advantages of the method and assembly according to the present invention will become apparent from the accompanying claims and abstract and from the following detailed description of a preferred embodiment in which reference is made to the accompanying drawings.

BRIEF DESCRIPTION OF THE DRAWINGS

FIG. 1 is a schematic longitudinal sectional view of a pressure monitoring assembly according to the invention, which is retrievably installed in a side pocket in a production tubing above an ESP in an oil production well.

DETAILED DESCRIPTION OF A PREFERRED EMBODIMENT

FIG. 1 shows a well 1 for production of crude oil, water and/or other fluids, which traverses an underground formation 2. The well 1 comprises a well casing 3, which is provided with perforations 4 through which fluid flows into the well 1 as illustrated by arrows 5.

A production tubing 6 is suspended within the well 1 from a wellhead (not shown) such that an electrical submersible pump (ESP) 7 is located above the inflow zone 8 for pumping fluid into the production tubing 6.

The production tubing 6 is provided with a side pocket 9 in which a pressure monitoring assembly 10 is arranged.

The side pocket 9 comprises an opening 13 which is located between a pair of annular seals 14 and 15 such a annular section 16 between the inner wall of the side pocket 9 and the outer wall of the tubular housing of the pressure monitoring assembly 10 is created in which the fluid pressure is substantially similar to the fluid pressure in the annular space 12 between the production tubing 6 and well casing 3. The fluid pressure in the annular space 12 is slightly lower than the fluid pressure pi at the pump inlet openings 17, and/or the Bottom-Hole Pressure (BHP), because of the hydrostatic fluid pressure of the fluid column between the inlet openings 17 of the ESP and the opening 13.

The pressure sensor assembly 10 comprises a first pressure sensor 20 which measures the fluid pressure p1 in the annular section 16 and a second pressure sensor 21 and a second pressure sensor 21, which measures the fluid pressure $p_2$ in the interior 22 of the production tubing 6.

The pressure sensor assembly 10 is provided with a processor for monitoring the pressures $p_1$ and $p_2$ and the difference $\Delta p$ between the pressures $p_1$ and $p_2$. The thus monitored pressures and pressure difference may be stored in a memory and/or are transmitted by a wireless signal transmitter 23 to a receiver (not shown) at or near the wellhead and/or the ESP 7.

The pressure sensor assembly 10 according to the invention provides a very efficient and simple device for monitoring the pressure difference $\Delta p$ between the interior 22 and exterior 12 of the production tubing 6, which pressure difference is substantially similar to the pressure difference $\Delta p = p_d - p_i$ between the outlet and inlet openings of the ESP 7.

Instead of transmitting the monitored pressure difference and/or other pressure data to surface by means of a wireless signal transmitter 23 the monitored pressure data may be stored in the memory of the pressure sensor assembly 10 over a prolonged period of time such after retrieval of the pressure sensor assembly 10 to surface by a robotic or wireline operated kickover tool the stored pressure data are transferred to a pressure data processing unit at the earth surface.

The pressure data processing unit may provide a graphical display of the monitored pressure difference $\Delta p$, and/or the pump inlet pressure $p_i$ and/or Bottom-Hole Pressure (BHP) over time, such that any deviation of the monitored pump inlet pressure $p_i$, Bottom Hole Pressure (BHP) and/or pressure difference $\Delta p$ from a pressure $p_i$, Bottom-Hole Pressure (BHP) and/or pressure difference $\Delta p$ at which the ESP 7 operates optimally can be assessed and analysed, and an operator may subsequently adjust the settings of the ESP 7.

The housing of the pressure sensor assembly may have a substantially tubular shape and may be provided with a fishing neck for connecting the pressure sensor assembly to a wireline operated or robotic installation tool, which is configured to lower and raise the pressure sensor assembly through the production tubing, and to insert and remove the pressure sensor assembly into and from the side pocket.

The pressure data may be transmitted to surface by a wireless transmission system or stored in the retrievable assembly for subsequent analysis after retrieval of the assembly from the well.

Optionally the pressure sensor assembly is equipped with a data storage unit in which the monitored pressures or pressure difference data are stored and the stored data are transferred to a data processing unit after retrieval of the pressure sensor assembly from the well.

Alternatively, the pressure sensor assembly is provided with a data transmission unit for wireless transmission of the measured pressure difference to a receiver which is connected to a monitoring or control assembly for monitoring and/or controlling the performance of the pump and with a battery for supplying electrical power to the data transmission unit and to the pressure sensor assembly.

The pump may be an electrical submersible pump (ESP), which is connected to the production tubing within an oil production well.

These and other features, embodiments and advantages of the method and assembly according to the present invention will become apparent from the accompanying claims and abstract and from the following detailed description of a preferred embodiment in which reference is made to the accompanying drawings.

We claim:

1. A method for monitoring the pressure in a well, the method comprising:

connecting a pump to a production tubing within the well such that the pump pumps well effluents from an inflow region of the well into the production tubing;

providing the production tubing with a side pocket which comprises an opening that provides fluid communication between the interior of the side pocket and an annular space surrounding the production tubing, which space is in fluid communication with the inflow region of the well;

inserting a pressure sensor assembly having a housing into the side pocket such that the opening is located between a pair of annular seals that are mounted on the housing of the pressure sensor assembly; and monitoring the pressure difference across the pump by inducing the pressure sensor assembly to measure a pressure difference between a section of the side pocket which is fluid communication with the interior of the production tubing and a section of the interior of the side pocket which is located between the annular seals; wherein the pressure sensor assembly comprises:

a first pressure sensor which measures the fluid pressure in the section of the side pocket which is connected in fluid communication with the interior of the production tubing;

a second pressure sensor which measures the fluid pressure in the section of the interior of the side pocket which is located between the annular seals; and means for monitoring the difference of the fluid pressures measured by the first and second pressure sensor and for transmitting the measured pressures or pressure difference to a data transmission or data storage unit.

2. The method of claim 1, wherein the pressure sensor assembly is provided with a signal transmission unit for wireless transmission of the measured pressure difference to a receiver which is connected to a monitoring or control assembly for monitoring or controlling the performance of the pump and with a battery for supplying electrical power to the signal transmission unit and the pressure sensor assembly.

3. The method of claim 1, wherein the pump is an electrical submersible pump (ESP), which is connected to the production tubing within an oil production well.

4. The pressure sensor assembly of claim 1, wherein the housing has a substantially tubular shape and is provided with a fishing neck for connecting the pressure sensor assembly to a wireline operated or robotic installation tool, which is configured to lower and raise the pressure sensor assembly through the production tubing, and to insert and remove the pressure sensor assembly into and from the side pocket.

5. The method of claim 1, wherein the housing of the pressure sensor assembly has a substantially tubular shape and is provided with a fishing neck for connecting the pressure sensor assembly to a wireline operated or robotic installation tool, which is configured to lower and raise the pressure sensor assembly through the production tubing, and to insert and remove the pressure sensor assembly into and from the side pocket.

6. The method of claim 5, wherein the pressure sensor assembly is equipped with a data storage unit in which the monitored pressure or pressure difference data are stored and the stored data are transferred to a data processing unit after retrieval of the pressure sensor assembly from the well.

* * * * *